US009692142B2

(12) United States Patent
Ek et al.

(10) Patent No.: US 9,692,142 B2
(45) **Date of Patent: *Jun. 27, 2017**

(54) INVERTED F-ANTENNAS AT A WIRELESS COMMUNICATION NODE

(71) Applicant: Telefonaktiebolaget L M Ericsson (Publ), Stockholm (SE)

(72) Inventors: Anders Ek, Hisings Backa (SE); Ola Kaspersson, Varberg (SE); Håkan Karlsson, Gothenburg (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/010,178

(22) Filed: Jan. 29, 2016

(65) Prior Publication Data

US 2016/0149316 A1 May 26, 2016

Related U.S. Application Data

(63) Continuation of application No. 13/920,781, filed on Jun. 18, 2013, now Pat. No. 9,252,502, which is a (Continued)

(51) Int. Cl.
*H01Q 1/38* (2006.01)
*H01Q 21/28* (2006.01)

(Continued)

(52) U.S. Cl.
CPC ..... *H01Q 21/28* (2013.01); *H01Q 1/243* (2013.01); *H01Q 1/38* (2013.01); *H01Q 1/521* (2013.01);

(Continued)

(58) Field of Classification Search
CPC H01Q 1/38; H01Q 21/28; H01Q 9/04; H01Q 1/243; H01Q 1/521; H01Q 21/12;

(Continued)

(56) References Cited

U.S. PATENT DOCUMENTS 4,907,006 A * 3/1990 Nishikawa ..... H01Q 1/32 343/700 MS
5,835,063 A 11/1998 Brachat et al.

(Continued)

FOREIGN PATENT DOCUMENTS

EP 2083472 A1 7/2009
WO 2009080110 A1 7/2009

OTHER PUBLICATIONS

Thysen, et al. "Design considerations for low antenna correlation and mutual coupling reduction in multi antenna terminals," European Transactions on Telecommunicaitons, Wiley & Sons, vol. 18, No. 3, Apr. 1, 2007, XP001542038, ISSN: 1124-318X DOI: 10.1002/ETT.1111, pp. 319-326.

(Continued)

*Primary Examiner* — Tho G Phan
(74) *Attorney, Agent, or Firm* — Rothwell, Figg, Ernst & Manbeck, P.C.

(57) ABSTRACT

The disclosure relates to a node in a wireless communication arrangement, the node comprising an antenna arrangement that comprises a first and second inverted F antenna. The inverted F antennas comprise a corresponding first and second feed connection, first and second ground connection and a corresponding first and second radiating element mainly extending from the respective ground connection along a corresponding first and second longitudinal extension. The inverted F antennas are arranged on, or in, a plane. Furthermore, the first and second radiating elements are extending in opposite directions along their respective longitudinal extensions from the respective ground connections, the first longitudinal extension and the second longitudinal extension being mutually parallel. The closest distance between the first radiating element and the second radiating element exceeds $0.4*\lambda_0$, where $\lambda_0$ is the wave- (Continued)

length for the center frequency of the frequency band for which the inverted F antennas are intended.

12 Claims, 3 Drawing Sheets

Related U.S. Application Data continuation of application No. PCT/EP2013/062567, filed on Jun. 18, 2013.

(51) Int. Cl.

| | |
|---|---|
| ***H01Q 21/29*** | (2006.01) |
| ***H01Q 1/24*** | (2006.01) |
| ***H01Q 1/52*** | (2006.01) |
| ***H01Q 9/04*** | (2006.01) |
| ***H01Q 9/42*** | (2006.01) |
| ***H01Q 21/12*** | (2006.01) |
| ***H01Q 5/371*** | (2015.01) |

(52) U.S. Cl.
CPC ..... *H01Q 5/371* (2015.01); *H01Q 9/04* (2013.01); *H01Q 9/0421* (2013.01); *H01Q 9/42* (2013.01); *H01Q 21/12* (2013.01); *H01Q 21/29* (2013.01)

(58) Field of Classification Search
CPC ..... H01Q 21/29; H01Q 5/371; H01Q 9/0421; H01Q 9/42
USPC ..... 343/700 MS, 702, 829, 846
See application file for complete search history.

(56) References Cited

U.S. PATENT DOCUMENTS

| | | | | |
|---|---|---|---|---|
| 6,480,155 | B1 * | 11/2002 | Eggleston | H01Q 1/243 343/700 MS |
| 6,768,460 | B2 * | 7/2004 | Hoashi | H01Q 1/22 343/700 MS |
| 7,202,826 | B2 * | 4/2007 | Grant | H01Q 1/3275 343/700 MS |
| 7,233,291 | B2 * | 6/2007 | Elkobi | H01Q 1/243 343/700 MS |
| 7,427,955 | B2 * | 9/2008 | Choi | H01Q 1/22 343/700 MS |
| 7,733,271 | B2 * | 6/2010 | Moon | H01Q 9/0421 343/700 MS |
| 8,462,065 | B2 | 6/2013 | Arai et al. | 343/754 |
| 2005/0195119 | A1 | 9/2005 | Gaucher et al. | |
| 2008/0094302 | A1 | 4/2008 | Murch et al. | |

OTHER PUBLICATIONS

International Search Report and Written Opinion issued in corresponding PCT Application No. PCT/EP2013/062567 on Mar. 13, 2014, 14 pages.

Karaboikis, M., et al., "Compact Dual-Printed Inverted-F Antenna Diversity Systems for Portable Wireless Devices", IEEE Antennas and Wireless Propagation Letters, vol. 3, 2004, pp. 9-14.

Hu, Z., "Antennas With Frequency Domain Control For Future Communication Systems", Thesis submitted to the College of Engineering and Physical Sciences, University of Birmingham, for the degree of Doctor of Philosophy, 2012, 81 pages.

Irshaid, M., et al. "Multi-Antenna Decoupling", Aalborg University, Denmark, Department of Electronic Systems, Mobile Communications 2009, 10th Semester: Master Thesis, 2009, 69 pages.

Kulkarni, A., "Investigation on Compact Antenna Solutions For Future 4G LTE Wireless Devices With MIMO Implementation", Thesis presented to the Faculty of San Diego State University, in partial fulfillment of the Degree of Master of Science in Electrical Engineering, Spring 2012, 27 pages.

* cited by examiner

INVERTED F-ANTENNAS AT A WIRELESS COMMUNICATION NODE

CROSS-REFERENCE TO RELATED APPLICATIONS

This application is a continuation of U.S. application Ser. No. 13/920,781, filed on Jun. 18, 2013 (published as U.S. Pat. Pub. 20140368405), which is a continuation of PCT/EP2013/062567, filed on Jun. 18, 2013. The above identified applications and publications are incorporated by reference.

TECHNICAL FIELD

The present invention relates to a node in a communication system. The node comprises an antenna arrangement which in turn comprises a first inverted F antenna and a second inverted F antenna. The first inverted F antenna comprises a first feed connection, a first ground connection and a first radiating element mainly extending from the first ground connection along a first longitudinal extension. Correspondingly, the second inverted F antenna comprises a second feed connection, a second ground connection and a second radiating element mainly extending from the second ground connection along a second longitudinal extension. The inverted F antennas are arranged on, or in, a plane.

BACKGROUND

Omni-directional antennas are often used for small cells such as so-called pico-cells and indoor coverage. Such antennas are also used at user terminals such as laptops and cell phones. The radiation pattern requirements will depend on which type of site and the propagation scenario that the antenna is intended for.

Most common in this context are vertically polarized omni-directional dipole antennas. When MIMO (Multiple Input Multiple Output) is introduced with several radio channels, multiple uncorrelated antennas are needed.

An uncorrelated sector antenna can be accomplished by using for example a patch-antenna with two orthogonal polarizations, vertical and horizontal. Orthogonal omni-directional antennas are considerably more difficult to accomplish, in particular an omni-directive, horizontally polarized wide band antenna. Most common is to use the horizontal distance between vertically polarized antennas to get uncorrelated radio channels.

Vertically polarized antennas must be well separated, in the order of several wavelengths, to achieve good multipath environment and therefore also good MIMO performance in all directions of the horizontal plane. However, large separation is not feasible when the antennas need to be integrated in small radio units and on low frequency bands. Half wave dipoles and micro strip patch antennas, for example, are relatively large, and a large separation between any two of these antennas becomes difficult to integrate in a small radio unit.

It is therefore a desire to provide a node in a wireless communication system that comprises an antenna arrangement that provides omni-directional coverage, an enhanced MIMO performance and that occupies a relatively small space.

SUMMARY

It is an object of the present invention to provide a node with an antenna arrangement that provides omni-directional coverage, an enhanced MIMO performance and that occupies a relatively small space.

Said object is obtained by means of a node in a communication system. The node comprises an antenna arrangement which in turn comprises a first inverted F antenna and a second inverted F antenna. The first inverted F antenna comprises a first feed connection, a first ground connection and a first radiating element mainly extending from the first ground connection along a first longitudinal extension. Correspondingly, the second inverted F antenna comprises a second feed connection, a second ground connection and a second radiating element mainly extending from the second ground connection along a second longitudinal extension. The inverted F antennas are arranged on, or in, a plane.

The first radiating element and the second radiating element are extending in opposite directions along their respective longitudinal extensions from the respective ground connections, where the first longitudinal extension and the second longitudinal extension are mutually parallel. The closest distance between the first radiating element and the second radiating element exceeds $0.4*\lambda_0$, where $\lambda_0$ is the wavelength for the centre frequency of the frequency band for which the inverted F antennas are intended.

According to an example, the first inverted F antenna comprises a first upper radiating element and the second inverted F antenna comprises a second upper radiating element.

According to another example, the plane is in the form of an electrically conducting ground plane positioned on a dielectric material.

According to another example, the antenna arrangement comprises planar inverted F antennas and a partially surrounding ground plane, where the inverted F antennas and the ground plane are arranged in a plane.

More examples are disclosed in the dependent claims.

A number of advantages are obtained by means of the present invention. For example: Suitable for integration into small radio units; Low profile and no protruding items; Enables enhanced 2×2 MIMO performance; Suitable for multiband applications; Displays small visual antenna volume; and Provides an omni-directional antenna radiation pattern.

BRIEF DESCRIPTION OF THE DRAWINGS

The present invention will now be described more in detail with reference to the appended drawings, where.

DETAILED DESCRIPTION

Figure 1:
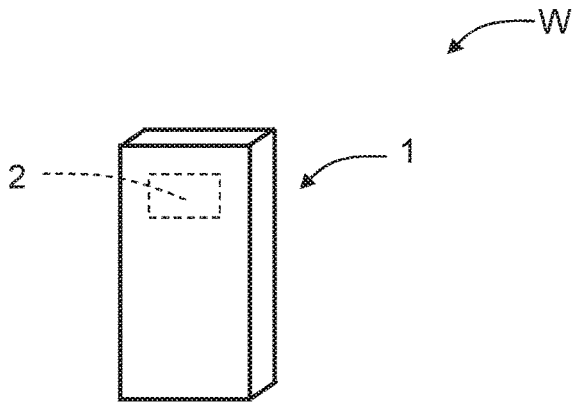
FIG. 1 shows a schematic view of a node in a wireless communication system.

With reference to FIG. 1, there is a node 1 in a wireless communication arrangement W. The node 1, which for example may be in the form of a pico station or a user terminal, comprises an antenna arrangement 2.

Figure 2:
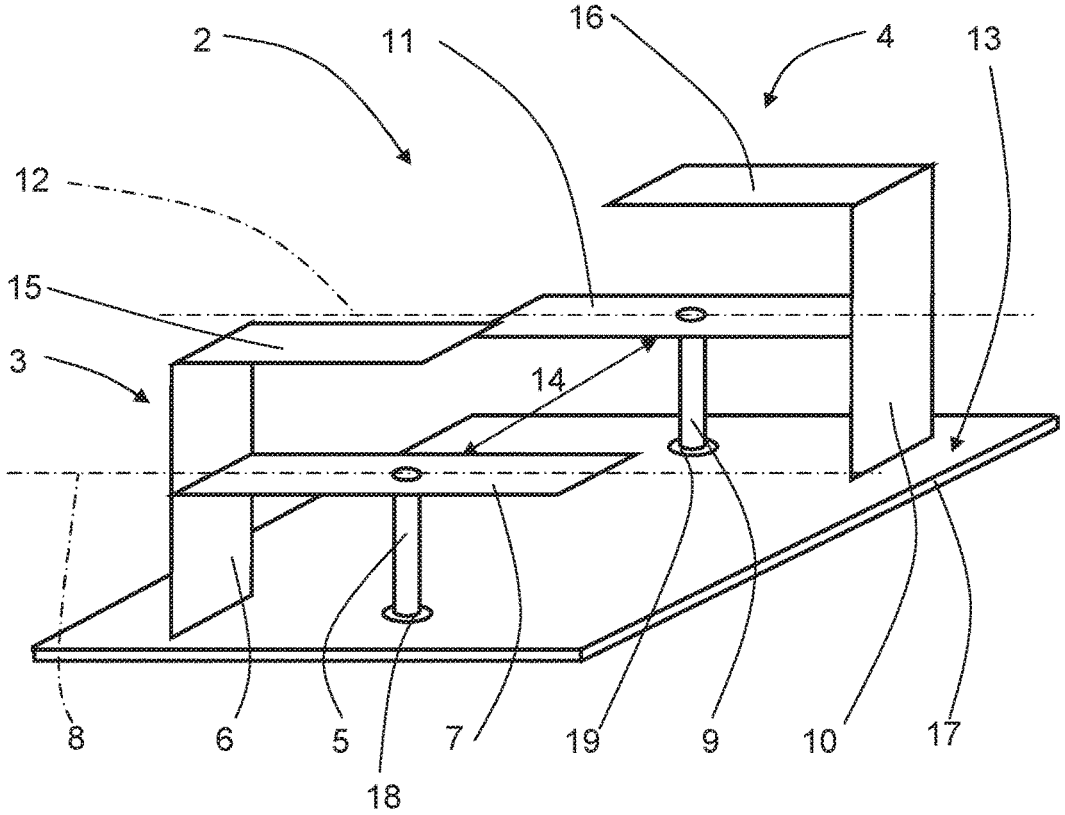
FIG. 2 shows a schematic perspective side view of an antenna arrangement according to a first example of the present invention.
Figure 3:
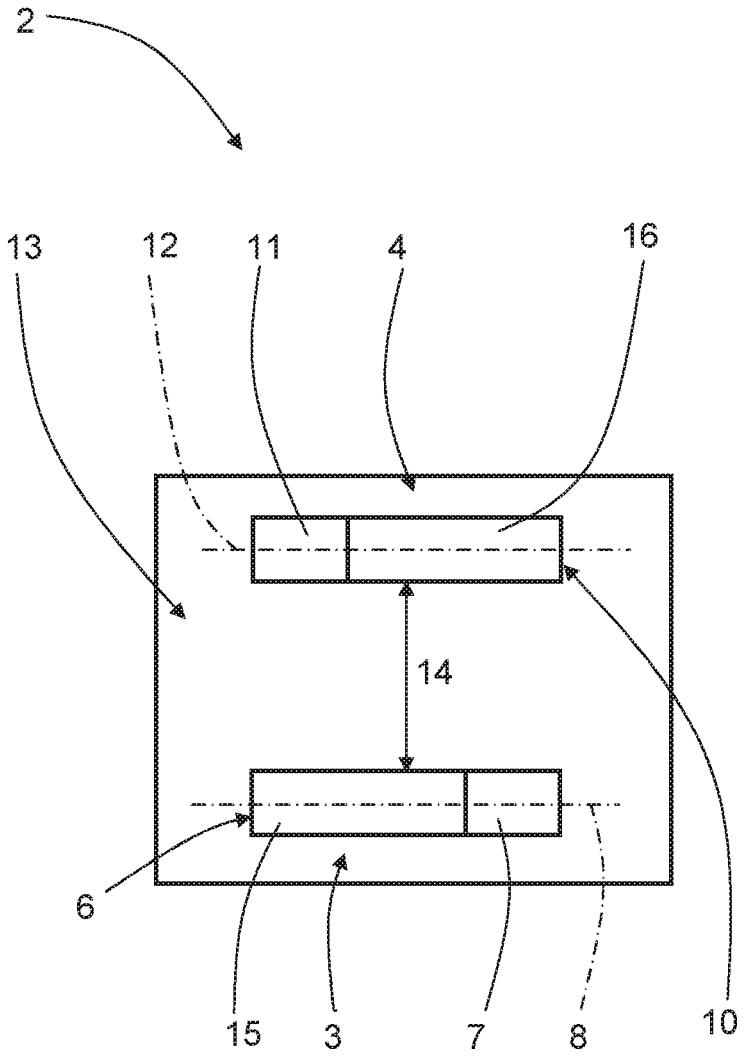
FIG. 3 shows a schematic top view of an antenna arrangement according FIG. 2.

With reference also to FIG. 2 and FIG. 3, showing a first example, the antenna arrangement 2 comprises a first inverted F antenna 3 and a second inverted F antenna 4. The first inverted F antenna 3 comprises a first feed connection 5, a first ground connection 6 and a first radiating element 7 mainly extending from the first ground connection 6 along a first longitudinal extension 8. Correspondingly, the second inverted F antenna 4 comprises a second feed connection 9, a second ground connection 10 and a second radiating element 11 mainly extending from the second ground connection 10 along a second longitudinal extension 12. The inverted F antennas 3, 4 are arranged on a plane 13, here in the form of an electrically conducting ground plane positioned on a dielectric material 17.

The first inverted F antenna 3 comprises a first upper radiating element 15, running parallel to the first radiating element 7 and being positioned farther away from the ground plane 13 than the first radiating element 7. Correspondingly, the second inverted F antenna 4 comprises a second upper radiating element 16, running parallel to the second radiating element 11 and being positioned farther away from the ground plane 13 than the second radiating element 11.

Each feed connection 5, 9 is running to, and electrically connecting, the corresponding first radiating element 7 and second radiating element 11 through a corresponding aperture 18, 19 in the ground plane 13. In this way, the feed connections 5, 9 are not short-circuited to the ground plane 13.

Each radiating element 7, 11, 15, 16 runs parallel to the ground plane 13 and is in the form of a thin electrically conducting metal strip with a certain width.

According to the present invention, the first radiating elements 7, 15 and the second radiating elements 11, 16 are extending in opposite directions along their respective longitudinal extensions 8, 12 from the respective ground connections 6, 10, where the first longitudinal extension 8 and the second longitudinal extension 12 are mutually parallel. Furthermore, the closest distance 14 between the radiating elements 7, 11 exceeds $0.4*\lambda_0$, where $\lambda_0$ is the wavelength for the centre frequency $f_0$ of the frequency band $f_B$ for which the inverted F antennas 3, 4 are intended.

Figure 4:
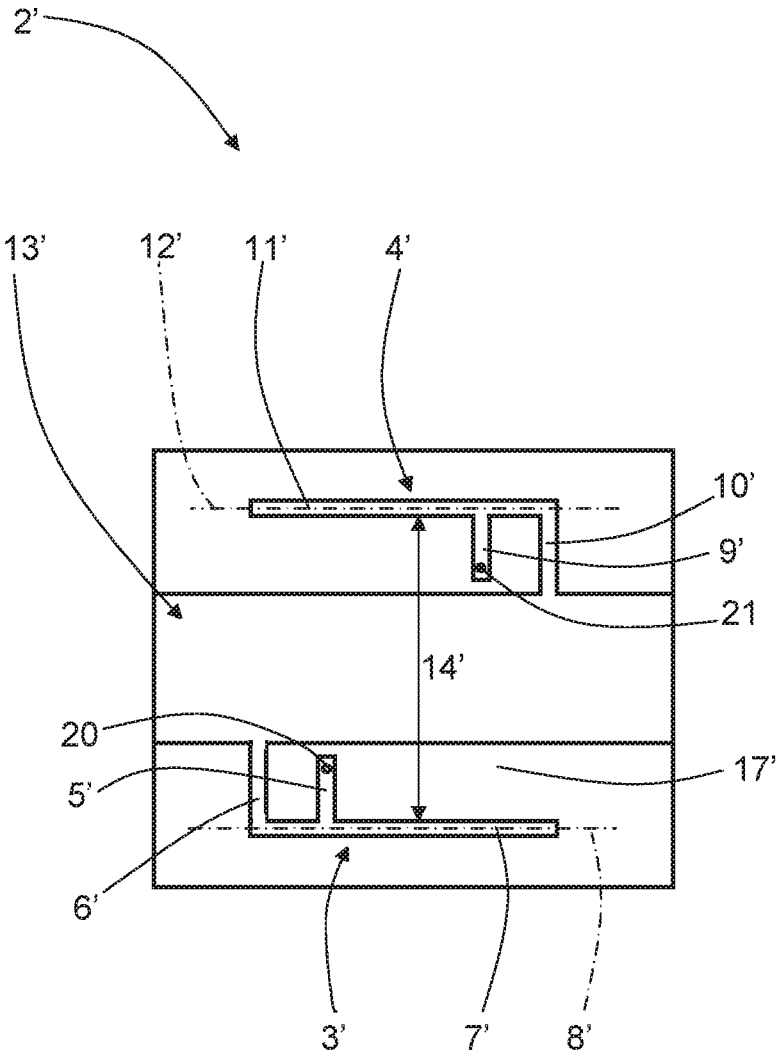
FIG. 4 shows a schematic top view of an antenna arrangement according to a second example of the present invention.

With reference to FIG. 4, showing a second example, it is also conceivable that the inverted F antennas are formed in one plane as etched structures, more commonly known as planar inverted F antennas (PIFA:s). This form allows a relatively thin structure. In FIG. 4, there is an antenna arrangement 2' which comprises a first planar inverted F antenna 3' and a second planar inverted F antenna 4'. The first planar inverted F antenna 3' comprises a first feed connection 5' with an interconnecting first via 20, a first ground connection 6' and a first radiating element 7' mainly extending along a first longitudinal extension 8'. Correspondingly, the second planar inverted F antenna 4' comprises a second feed connection 9' with an interconnecting second via 21, a second ground connection 10' and a second radiating element 11' mainly extending along a second longitudinal extension 12'.

The planar inverted F antennas 3', 4' are formed in a plane, having been etched from an initial copper layer that now forms the planar inverted F antennas 3', 4' and a partially surrounding ground plane 13'. The ground plane 13' is as in the first example positioned on a dielectric material 17'.

The first radiating element 7' and the second radiating element 11' of the planar inverted F antennas 3', 4' are extending in opposite directions along their respective longitudinal extensions 8', 12' from the respective ground connections 6', 10'. The first longitudinal extension 8' and the second longitudinal extension 12' are mutually parallel. Furthermore, the closest distance 14' between the first radiating elements 7' and the second radiating element 11' exceeds $0.4*\lambda_0$, where $\lambda_0$ is the wavelength for the centre frequency $f_0$ of the frequency band $f_B$ for which the planar inverted F antennas 3', 4' are intended.

The interconnecting vias 20, 21 are further connected to a corresponding suitable feeding device (not shown), such as a corresponding radio unit.

The present invention thus uses two inverted F antennas 3, 4 that are mounted in opposite directions, i.e. one is rotated 180 degrees relative the other. The inverted F antennas 3, 4 may be placed at a corner or an edge at the ground plane 13/dielectric material 17. The separation between the inverted F antennas 3, 4 is such that the closest distance 14 between the first radiating element 7 and the second radiating element 11 exceeds $0.4*\lambda_0$, where $\lambda_0$ is the wavelength for the centre frequency $f_0$ of the frequency band $f_B$ for which the planar inverted F antennas 3, 4 are intended. The present invention thus lies in the inventors' awareness of the advantages conferred by means of the combination of two inverted F antennas 3, 4 that are mounted in opposite directions, i.e. one is rotated 180 degrees relative the other, and of having a closest distance 14 between the radiating elements 7, 11 that exceeds $0.4*\lambda_0$ according to the above.

By means of the arrangement above, the polarizations of the inverted F antennas 3, 4 become mutually orthogonal. For example, if the radiated power at the first feed connection 5 has right hand circular polarization, the radiated power at the second feed connection 9 has left hand circular polarization.

The inverted F antennas 3, 4 are oriented so that the antenna patterns are uncorrelated and have a good gain balance in all directions of the horizontal plane. This concept creates an omni-directional antenna with uncorrelated patterns and hence good MIMO (Multiple Input Multiple Output) performance.

FIG. 2 and FIG. 3 show two inverted F antennas 3, 4 mounted at the edges of a ground plane 13 in a node 1. In a functional example, the inverted F antennas 3, 4 are mounted in a sink that will have an additional environmental cover. The inverted F antennas 3, 4 are furthermore tuned to be operating at a relatively low centre frequency such as 720 MHz, which is low in relation to the electrical size of the ground plane 13. This is only one example, many other types of arrangements and frequencies are of course conceivable.

In comparison, two dipoles would need to be mounted on top of the unit. These would constitute protruding objects that would disturb mounting and/or handling of the node itself.

An inverted F antenna is an inherently much smaller antenna element than for example a half-wave dipole or a microstrip patch antenna. The resonant size of an inverted F antenna is only one quarter of a wavelength, and it can be made very thin.

The present invention is not limited to the examples above, but may vary freely within the scope of the appended claims. For example, the inverted F antennas 3, 4 are shown as having equal design; this is not necessary, and they may have design differences as long as the functionality is preserved.

Although each inverted F antenna 3, 4 has been shown to have two radiating elements each, this is only by way of example. Each inverted F antenna 3, 4 may comprises any number of radiating elements, but at least one which is connected to feed connection. As an example, one inverted F antenna may have two radiating elements and the other inverted F antenna may have one radiating element.

The inverted F antennas 3, 4 do not have to be positioned facing each other along their respective longitudinal extensions 8, 12, but each inverted F antennas 3, 4 may be suitably positioned along its longitudinal extension 8, 12.

Although the description above has related to a RBS in a wireless communications system, the present invention may relate to any type of node 1 in a communication system 2, where communication either is wireless and/or via some type of wire such as copper or fiber. The node may be constituted by a hand-held device or a base station, for example a base station, a repeater device or a user terminal that is communicating with another device. A user terminal may for example be in the form of a cell phone, a laptop computer or a touch pad device.

The present invention applies to any F-shaped antenna, such as the previously described planar inverted F-antenna (PIFA), and may be realized in various forms and implementations. For example, the strips forming the inverted F antennas in the first example may be made in any suitable conducting material, even metalized plastic. A PIFA may have radiating elements that are meandered in order to occupy less surface area.

The antenna arrangement 2 is arranged to be used in both transmission and reception, normally having reciprocal radiation properties.

The inverted planar F antennas 3', 4' and the ground plane 13' may for example either be etched from an initial copper layer that is positioned on a dielectric material 17', or formed from sheet metal parts that are positioned on a carrier material, such as a dielectric material 17'. Such sheet metal parts may be cut out from a larger sheet of metal, for example by means of a laser cutting device.

Terms such as orthogonal and parallel are not to be interpreted as mathematical exact, but within what is practically obtainable within this field of technology.

The invention claimed is:

1. A node in a wireless communication arrangement, the node comprising:

an antenna arrangement comprising:

a base having a top side lying in a first plane and an opposite bottom side lying in a second plane parallel with the first plane;

a first inverted F antenna; and a second inverted F antenna, wherein the first inverted F antenna comprises a first feed connection, a first ground connection and a first radiating element being positioned above the top side of the base and lying in a third plane that is parallel with and spaced apart from the top side of the base, the first feed connection electrically connected to the first radiating element, the second inverted F antenna comprises a second feed connection, a second ground connection and a second radiating element being positioned above the top side of the base and lying in said third plane, the second feed connection electrically connected to the second radiating element, the first ground connection lies on a fourth plane that is perpendicular with the first and second planes, the second ground connection lies on a fifth plane that is perpendicular with the first and second planes, the fifth plane is spaced apart from the fourth plane.

2. The node according to claim 1, wherein the first inverted F antenna comprises a first upper radiating element and that the second inverted F antenna comprises a second upper radiating element.

3. The node according to claim 1, wherein each radiating element runs parallel to the first plane.

4. The node according to claim 1, wherein the base comprises an electrically conducting ground plane positioned on a dielectric material.

5. The node according to claim 4, wherein each feed connection is running to the corresponding radiating element through a corresponding aperture in the ground plane.

6. The node according to claim 1, wherein the shortest distance between the first radiating element and the second radiating element exceeds $0.4*\lambda 0$, where $\lambda 0$ is the wavelength for the centre frequency of a frequency band for which the first and second inverted F antennas are intended.

7. An antenna arrangement, comprising:

a first inverted F antenna; and a second inverted F antenna, wherein the first inverted F antenna comprises a first feed connection, a first ground connection and a first radiating element extending from the first ground connection along a first longitudinal extension that lies on a first plane, the second inverted F antenna comprises a second feed connection, a second ground connection and a second radiating element extending from the second ground connection along a second longitudinal extension, the first ground connection lies on a second plane that is perpendicular to the first plane in which lies the first longitudinal extension, the second ground connection lies on a third plane that is parallel with the second plane, the second plane is spaced apart from the third plane, the first radiating element extends from the first ground connection towards the third plane in which the second ground connection lies, and the second radiating element extends from the second ground connection towards the second plane in which the first ground connection lies.

8. The antenna arrangement according to claim 7, wherein the first inverted F antenna further comprises a first upper radiating element extending from the first ground connection towards the third plane, and the second inverted F antenna further comprises a second upper radiating element extending from the second ground connection towards the second plane.

9. The antenna arrangement according to claim 8, wherein each said radiating element runs parallel to a ground plane.

10. The antenna arrangement according to claim 7, wherein the ground plane is positioned on a dielectric material.

11. The antenna arrangement according to claim 10, wherein each feed connection is running to the corresponding radiating element through a corresponding aperture in the ground plane.

12. The antenna arrangement according to claim 7, the shortest distance between the first radiating element and the second radiating element exceeds $0.4*\lambda 0$, where $\lambda 0$ is the wavelength for the center frequency of a predetermined frequency band.

* * * * *